United States Patent [19]

Lapeyre

[11] 4,316,524

[45] * Feb. 23, 1982

[54] TWO-SPEED LADDER

[75] Inventor: James M. Lapeyre, New Orleans, La.

[73] Assignee: The Laitram Corporation, New Orleans, La.

[ * ] Notice: The portion of the term of this patent subsequent to Apr. 22, 1997, has been disclaimed.

[21] Appl. No.: 158,883

[22] Filed: Jun. 12, 1980

[51] Int. Cl.[3] ..... E06C 9/02; E06C 7/08

[52] U.S. Cl. ..... 182/93; 182/99; 182/106; 182/194; 52/182

[58] Field of Search ..... 182/100, 194, 93, 106, 182/189, 99; 52/182

[56] References Cited

U.S. PATENT DOCUMENTS

| | | | |
|---|---|---|---|
| 234,389 | 11/1880 | Cannon | 182/189 |
| 858,199 | 6/1907 | Modjeski | 182/194 |
| 2,641,401 | 6/1953 | James | 182/200 |
| 4,061,202 | 12/1977 | Campbell | 182/100 |
| 4,125,175 | 11/1978 | Ernst | 182/194 |
| 4,199,040 | 4/1980 | Lapeyre | 182/194 |

*Primary Examiner*—Reinaldo P. Machado
*Attorney, Agent, or Firm*—Weingarten, Schurgin & Gagnebin

[57] ABSTRACT

A ladder which can be ascended and descended at either of two rates and which comprises an array of half treads on one side of a stringer and an array of full treads on the opposite side of the stringer, each array being vertically spaced from the other along the length of the stringer. Treads are affixed to and extend from respective sides of the stringer, and at least one of the arrays includes outwardly extending portions affixed to a handrail.

5 Claims, 4 Drawing Figures

TWO-SPEED LADDER

FIELD OF THE INVENTION

This invention relates to ladders, and more particularly to a ladder which can be ascended and descended at either of two rates.

BACKGROUND OF THE INVENTION

A ladder is disclosed in U.S. Pat. No. 4,199,040, issued Apr. 22, 1980, entitled Ship Ladder, and assigned to the same assignee as this invention, which comprises a single stringer or central tread support disposed between upper and lower levels at a predetermined angle of inclination and having an array of half treads on each side of the stringer, each array being vertically spaced from the other along the length of the stringer. The half treads are affixed to and laterally extend from the respective sides of the stringer, and each includes an integral outwardly extending portion which terminates in a plane which is forward of a plane passing through the front edges of the treads. First and second handrails are disposed in this forward plane and are affixed to and supported by the outwardly extending tread portions. This novel ladder can be disposed at a relatively steep angle in comparison to a conventional ladder of the same tread width and riser height and provides sufficient safety and comfort to permit balanced use of the ladder, even without holding onto the handrails.

Ladders are known in which treads or rungs are alternately arranged along a single stringer or pole. In ascending and descending ladders of this known type, a user must face the ladder and support himself by holding onto the rungs to guide his ascent or descent. Such ladders of known construction cannot be descended facing forward, as with a stairway, and these known ladders also require a fair degree of dexterity on the part of a user and are not very comfortable to use.

SUMMARY OF THE INVENTION

The present invention provides a ladder similar to the ladder of the aforesaid U.S. Pat. No. 4,199,040 which can be employed in alternative ways to ascend and descend the ladder at different rates. This ladder comprises an array of half treads disposed along one side of a stringer or tread support, and an array of full treads disposed along the opposite side of the stringer, each array being vertically spaced from the other along the length of the stringer. The treads are affixed to and laterally extend from the respective sides of the stringer, and the half treads each include an integral outwardly extending portion which terminates in a plane which is forward of a plane passing through the front edges of the treads. A handrail is disposed in this forward plane and is affixed to and supported by the outwardly extending tread portions. The full treads are affixed to a second stringer and to which a second handrail can be supported. The full-width treads are of sufficient size to allow placement of both feet of a user on the tread, while the half treads are of a size to allow placement of a single foot of a user thereon. To ascend or descend the ladder at a relatively slow rate, a user employs the half treads and the adjacent portions of the full treads. To ascend or descend the ladder at a faster rate, the user employs only the full-width treads, which have a riser height which is twice the riser height between each half tread and the next full tread.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
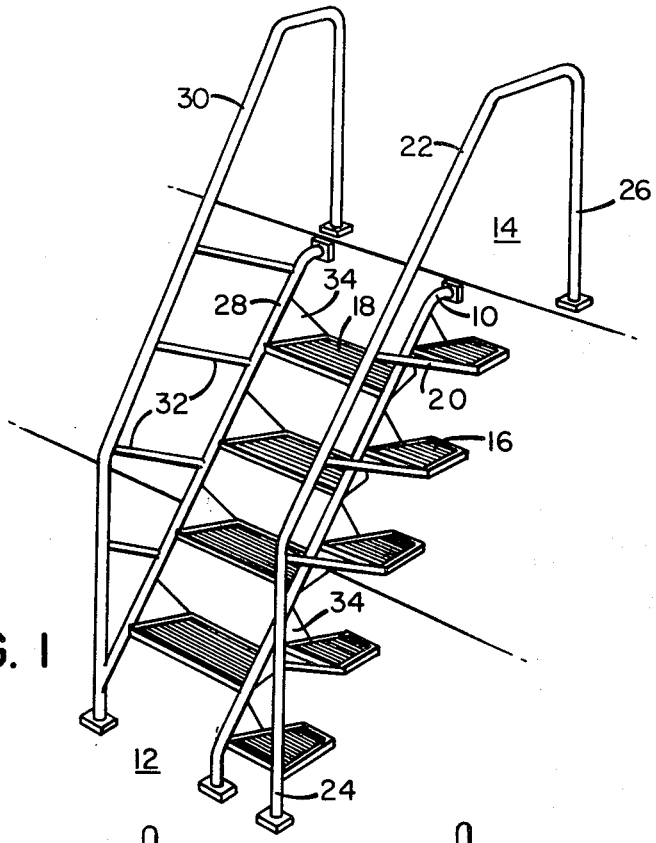
FIG. 1 is a pictorial view of a preferred embodiment of the novel two-speed ladder.
Figure 2:
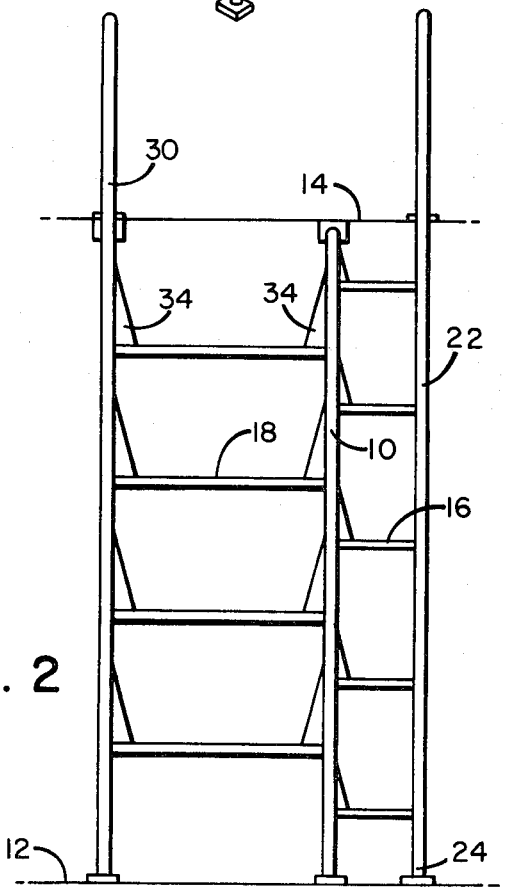
FIG. 2 is an elevation view of the embodiment of FIG. 1.

Referring to FIGS. 1 and 2, there is shown a ladder which comprises a stringer 10 disposed between a lower surface 12 and an upper surface 14, an array of half treads 16 disposed along one side of stringer 10 and equally spaced along the length thereof, and an array of full treads 18 disposed along the opposite side of stringer 10 and equally spaced along the length thereof. The array of half treads 16 and array of full treads 18 are alternately disposed on respective sides of the stringer. Each half tread 16 includes a laterally extending portion configured to accommodate the foot of a person using the ladder and an outwardly extending portion 20 which is affixed to a handrail 22. This handrail in the illustrated embodiment includes vertical portions 24 and 26 affixed to the respective floor surfaces 12 and 14. The outer end of full treads 18 are affixed to a stringer 28 disposed between the upper and lower surfaces and running parallel to stringer 10. A handrail 30 is affixed to stringer 28 and includes bracing struts 32. Bracing struts 34 are also provided for the attachment of the treads to the respective stringers. The handrails are positioned at a convenient distance forward of the treads so that a person using the ladder will feel secure in its use. The ladder can be ascended facing forward and can be descended facing outward from the ladder, as in descending a conventional stairway, rather than the rearward descent on a rung-type ladder. The half treads 16 are of a size to accommodate the foot of a user and of sufficient size to accommodate the normal outward angling of a foot. The full treads 18 are of a size to accommodate both feet of a user.

The ladder is operative to be ascended and descended at relatively faster and slower rates. To use the ladder for relatively slow ascent or descent, a user employs the half treads 16 and the adjacent portions of the full treads 18. For more rapid ascent or descent, the user employs only the full treads 18, as these treads have a riser height which is twice the riser height between each half tread and the next full tread.

Figure 3:
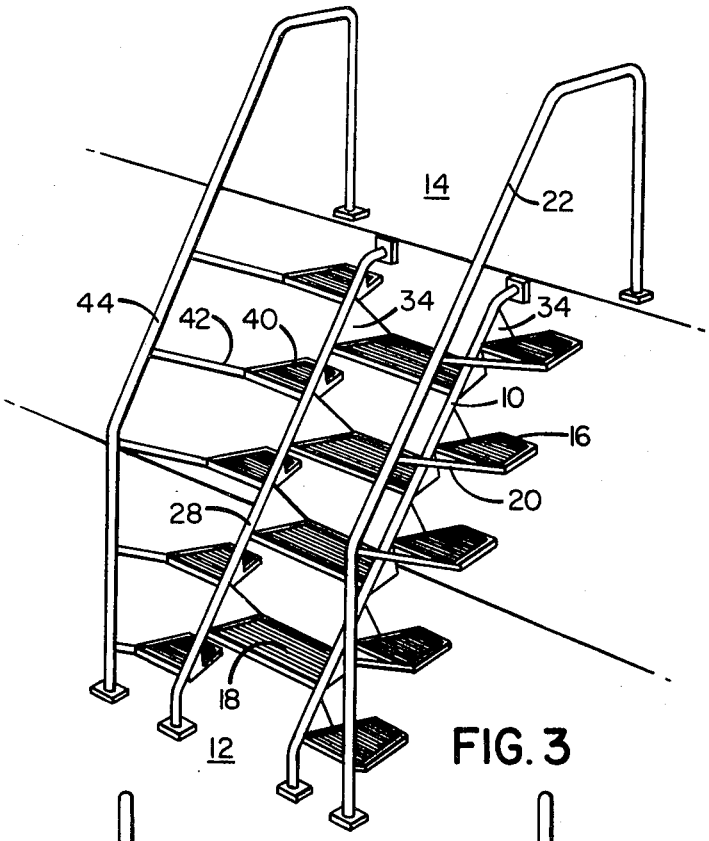
FIG. 3 is a pictorial view of an alternative embodiment of the two-speed ladder.
Figure 4:
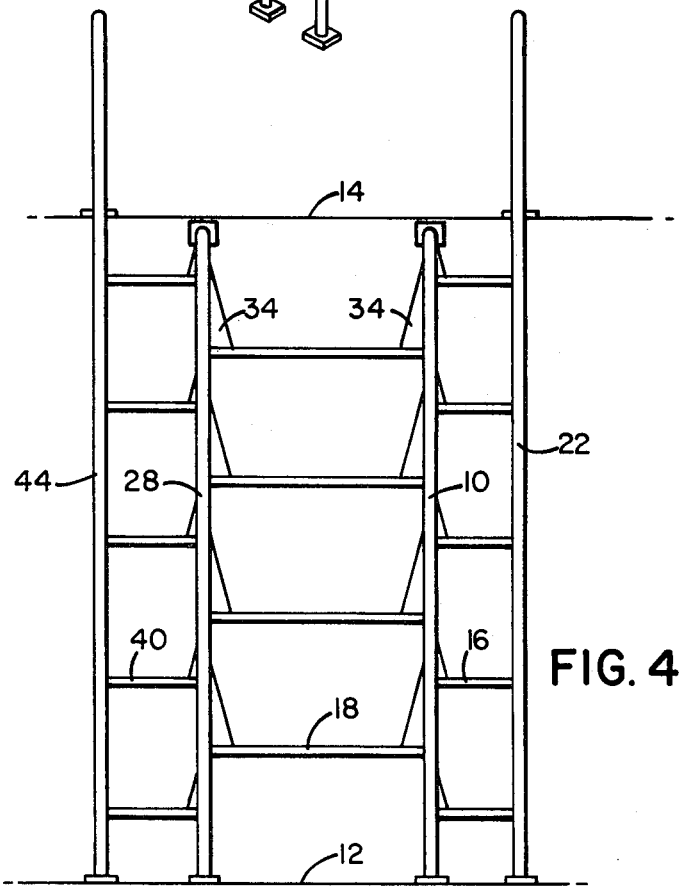
FIG. 4 is an elevation view of the embodiment of FIG. 3.

An alternative embodiment is shown in FIGS. 3 and 4 and additionally includes an array of half treads 40 on the opposite side of stringer 28 from full treads 18. These half treads 40 include outwardly extending portions 42 which are affixed to a handrail 44 which is secured to the lower and upper surfaces 12 and 14. This embodiment permits use of the ladder by two persons at the same time, since one person can ascend or descend the ladder using the half treads 16 and adjacent portions of full treads 18, while the other person can be utilizing half treads 40 and the adjacent portions of half treads 18.

An odd number of half treads is preferably employed so that a person can ascend or descend the ladder beginning and ending with the same foot. The ladder is safe and comfortable to use and is of a construction which is relatively simple and inexpensive. The ladder employs less floor space and overhead space to accommodate its horizontal run, since it is more steeply inclined than a conventional ladder providing the same degree of comfort and safety. To accommodate the usual range of adult sizes, the half-tread width (side-to-side extension) typically can be about 5–12 inches; the length of the tread (fore and aft extension) can be about 4–11 inches; and the riser height between adjacent treads can be about 5–12 inches. The full-tread width typically can be about 10–24 inches.

In the illustrated embodiments, the stringers and handrails are of tubular metal, and the treads and braces are of metal welded to the tubular components. Various constructions can be utilized such as shown and described in the aforesaid U.S. Pat. No. 4,199,040 which is incorporated herein by reference.

The invention is not to be limited except as indicated in the appended claims.

What is claimed is:

1. A ladder comprising:

a central tread support member adapted for mounting between an upper level and a lower level at a predetermined angle of inclination;

a first plurality of half tread members disposed on one side of said support member and equally spaced along the length thereof;

a second plurality of full tread members disposed along the opposite side of said support member and equally spaced along the length thereof;

said first and second plurality of tread members being disposed in alternating arrangement on respective sides of said support member;

each of said half tread members having a foot support portion outwardly extending from said support member and rail support means outwardly extending from the foot support portion and terminating substantially in a plane forward and parallel to a plane passing through the front edges of the foot support portions;

a first handrail attached to said rail support means and lying in the forward plane; and a second central tread support member adapted for mounting between said upper and lower levels and affixed to the outer ends of said full tread members.

2. The ladder of claim 1 including a second handrail affixed to the second central tread support member.

3. The ladder of claim 1 wherein the rail support means of said half tread members are integral with said foot support portion.

4. The ladder of claim 1 wherein each of said tread members includes bracing means affixing said tread members to the tread support members.

5. The ladder of claim 1 including a third plurality of half-tread members disposed on the opposite side of the second central tread support member than the plurality of full-tread members and in alternating arrangement with respect to the full tread members.

* * * * *